United States Patent [19]

Yao

[11] Patent Number: 4,808,300

[45] Date of Patent: Feb. 28, 1989

[54] SIMULTANEOUS REMOVAL OF AROMATICS AND WAX FROM LUBE DISTILLATE BY AN ADSORPTION PROCESS

[75] Inventor: Keith C. Yao, Sarnia, Canada

[73] Assignee: Exxon Research and Engineering Company, Florham Park, N.J.

[21] Appl. No.: 14,726

[22] Filed: Feb. 13, 1987

[51] Int. Cl.[4] ..... C10G 25/60

[52] U.S. Cl. ..... 208/307; 208/28; 208/305; 208/306

[58] Field of Search ..... 208/28, 305, 306, 307

[56] References Cited

U.S. PATENT DOCUMENTS

| | | | |
|---|---|---|---|
| 2,384,315 | 9/1945 | Kuhl | 196/44 |
| 2,574,434 | 11/1951 | Greentree | 208/305 |
| 2,647,858 | 8/1953 | Weisz | 208/305 |
| 2,870,230 | 1/1959 | Scott, Jr. et al. | 208/305 |
| 2,877,176 | 3/1959 | Wolff et al. | 208/307 |
| 2,884,384 | 4/1959 | Howell, Jr. et al. | 208/305 |
| 2,892,001 | 6/1959 | Wallin | 208/307 |
| 2,908,639 | 10/1959 | Carter et al. | 208/310 |
| 2,926,135 | 2/1960 | Engel et al. | 208/306 |
| 3,014,860 | 12/1961 | Douwes et al. | 208/254 |
| 3,224,955 | 12/1965 | Anderson | 208/28 |
| 3,243,366 | 3/1966 | Kimberlin, Jr. et al. | 208/26 |
| 3,462,358 | 8/1969 | Mills et al. | 208/14 |
| 3,513,089 | 5/1970 | Geach et al. | 208/28 |
| 3,654,128 | 4/1972 | Woodle | 208/33 |
| 3,681,230 | 8/1972 | Eagen et al. | 208/33 |
| 3,755,138 | 8/1973 | Chen et al. | 208/33 |
| 3,755,152 | 8/1973 | Gulick | 208/307 |
| 3,830,730 | 8/1974 | Mead et al. | 208/144 |
| 3,849,298 | 11/1974 | Funakubo et al. | 208/307 |
| 3,862,026 | 1/1975 | Friend et al. | 208/310 |
| 4,061,724 | 12/1977 | Grose et al. | 423/335 |
| 4,081,352 | 3/1978 | West et al. | 208/36 |
| 4,090,950 | 5/1978 | Reynolds | 208/89 |
| 4,104,294 | 8/1978 | Grose et al. | 260/448 |
| 4,137,154 | 1/1979 | Audeh | 208/254 |
| 4,404,118 | 9/1983 | Herskovits | 252/411 |
| 4,423,278 | 12/1983 | Yang et al. | 208/307 |
| 4,423,280 | 12/1983 | Dessau | 585/829 |
| 4,448,671 | 5/1984 | Dessau | 208/26 |
| 4,455,444 | 6/1984 | Kulprathipanja | 585/826 |
| 4,469,805 | 9/1984 | Kofke, Jr. et al. | 208/305 |
| 4,487,688 | 12/1984 | Dessau | 208/310 |
| 4,622,130 | 11/1986 | Stem | 208/87 |

FOREIGN PATENT DOCUMENTS

| | | | |
|---|---|---|---|
| 057980 | 8/1982 | European Pat. Off. . | |
| 083202 | 7/1983 | European Pat. Off. . | |
| 130043 | 1/1985 | European Pat. Off. . | |
| 0229424 | 11/1985 | Fed. Rep. of Germany | 208/307 |
| 2005299 | 4/1979 | United Kingdom . | |

OTHER PUBLICATIONS

"Removal of Nitrogen Compounds from Lubricating Oils", C. A. Audeh, Ind. Eng. Chem., Prod. Res. Dev., vol. 22, No. 2, 1983, pp. 276–279.

"Silicalite, A New Hydrophobic Crystalline Silica Molecular Sieve", Flanegen et al, Nature, vol. 271, 9, Feb. 1978, pp. 512–516.

*Primary Examiner*—W. J. Shine
*Assistant Examiner*—Helane Myers
*Attorney, Agent, or Firm*—Joseph J. Allocca

[57] ABSTRACT

Waxy oil distillates, preferably waxy petroleum oil distillates, most preferably waxy lube refrigerator, turbine, transformer or other speciality oil distillates which contain appreciable amounts of aromatics and polar molecule contaminants can have wax and aromatics/polars simultaneously and continuously removed from said oil using an adsorbent/desorbent system. The adsorbent system employs a combination of large pore polar adsorbent/hydrophobic molecular sieves. The desorbent system utilizes a combination small diameter polar solvent/large diameter non-polar solvent to regenerate the loaded adsorbent.

14 Claims, 3 Drawing Sheets

SIMULTANEOUS REMOVAL OF AROMATICS/POLARS AND WAX FROM LUBE DISTILLATE BY MAGNETICALLY STABILIZED BED (MSB) ADSORPTION

SIMULTANEOUS REMOVAL OF AROMATICS/POLARS AND WAX FROM LUBE DISTILLATE BY MAGNETICALLY STABILIZED BED (MSB) ADSORPTION

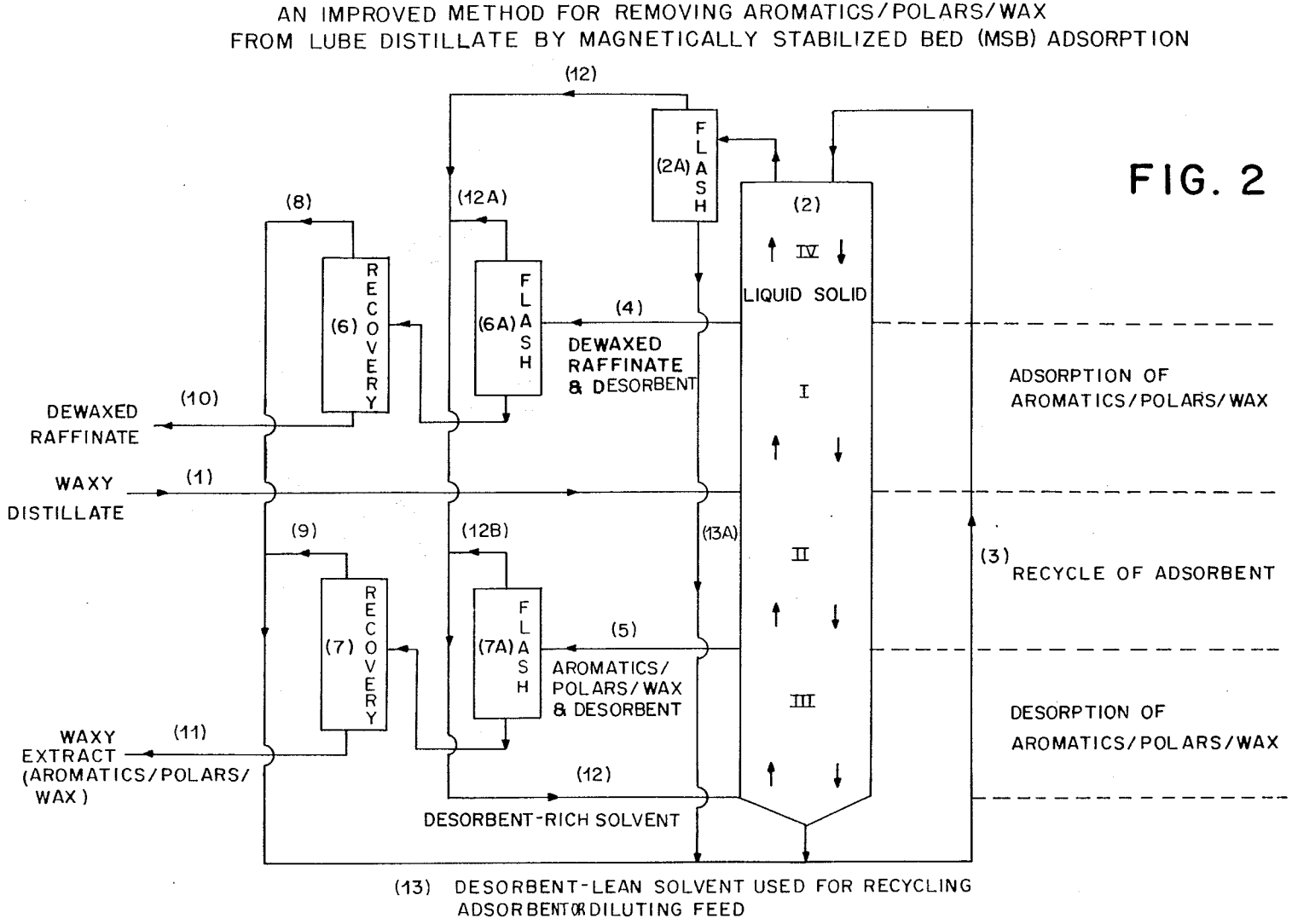
AN IMPROVED METHOD FOR REMOVING AROMATICS/POLARS/WAX
FROM LUBE DISTILLATE BY MAGNETICALLY STABILIZED BED (MSB) ADSORPTION
FIG. 2
ADSORPTION OF AROMATICS/POLARS/WAX
RECYCLE OF ADSORBENT
DESORPTION OF AROMATICS/POLARS/WAX
(3)
(2)
IV
LIQUID SOLID
I
II
III
(2A) FLASH
(4)
DEWAXED RAFFINATE & DESORBENT
(13A)
(5)
AROMATICS/ POLARS/WAX & DESORBENT
(12)
(12A)
(6A) FLASH
(12B)
(7A) FLASH
DESORBENT-RICH SOLVENT
(13) DESORBENT-LEAN SOLVENT USED FOR RECYCLING ADSORBENT & DILUTING FEED
(6) RECOVERY
(7) RECOVERY
(8)
(9)
(10)
(1)
(11)
DEWAXED RAFFINATE
WAXY DISTILLATE
WAXY EXTRACT (AROMATICS/POLARS/ WAX)

SIMULTANEOUS REMOVAL OF AROMATICS AND WAX FROM LUBE DISTILLATE BY AN ADSORPTION PROCESS

BRIEF DESCRIPTION OF THE INVENTION

Oil distillates containing wax and aromatic/polar contaminants can have the wax and aromatic/polar contaminants simultaneously and continuously removed therefrom by means of an adsorption process utilizing a combination adsorbent comprising a large-pore polar adsorbent and a hydrophobic molecular sieve. This combination adsorbent, identified in this specification and appended claims as "adsorbent" for the sake of simplicity is regenerated by use of a desorbent which comprises a combination of a small diameter polar solvent and large diameter non-polar solvent. Representative of large pore polar adsorbent is Ketjen high alumina base (an amorphous silica-alumina), while the hydrophobic molecular sieve can be silicalite. The desorbent can comprise a mixture of dichloromethane (DCM) or ketone, such as acetone or methylethylketone (MEK), which are small diameter polar solvents, in combination with isooctane, an example of a large diameter non-polar solvent.

The adsorption is carried out in the liquid phase at moderate temperatures, preferably between 25° C. to 250° C., and at atmospheric or only slightly elevated pressure, preferably 15 to 250 psig, at least sufficient pressure being applied, in relation to the temperature, to keep the system in liquid phase. Regeneration is preferably practiced at the same conditions of temperature and pressure as the adsorption step.

Adsorption/regeneration can be conducted in a cyclic, batch mode or in a continuous countercurrent mode. A continuous countercurrent procedure using a simulated moving bed or a true moving bed (i.e., magnetically stabilized bed) is preferred.

BACKGROUND OF THE INVENTION

Distillate oils intended for use as lube oils or speciality oils (such as refrigerator, transformer, turbine or white oils) are subject to very strict compositional and performance criterion. These include possessing low pour point, low haze point, low aromatics content and low polar content. These different goals and specification targets are currently met through the use of many and varied processing procedures. Distillate oils are dewaxed by solvent dewaxing processes utilizing cold solvents, as exemplified by the DILCHILL dewaxing process, the subject of U.S. Pat. No. 3,773,288. Dewaxing can also be accomplished using autorefrigerative solvent, such as propane or propylene. Recently, catalytic dewaxing processes employing zeolite molecular sieves have come into vogue. These oils must also possess low aromatics and polar compound levels and these goals are achieved by extraction procedures, such as solvent extraction utilizing phenol, furfural or n-methyl-2-pyrrolidone, for aromatics and polars removal. Polar compounds, such as basic nitrogen compounds, which are detrimental to the oils' oxidative stability, are further removed by means of catalytic denitrogenation processes or adsorption.

DESCRIPTION OF THE FIGURES

FIG. 2 is a schematic of a magnetically stabilized bed practicing simultaneous aromatic/wax adsorption, adsorbent regeneration by desorption with an improved desorbent solvent recovery feature.

THE INVENTION

Figure 1:
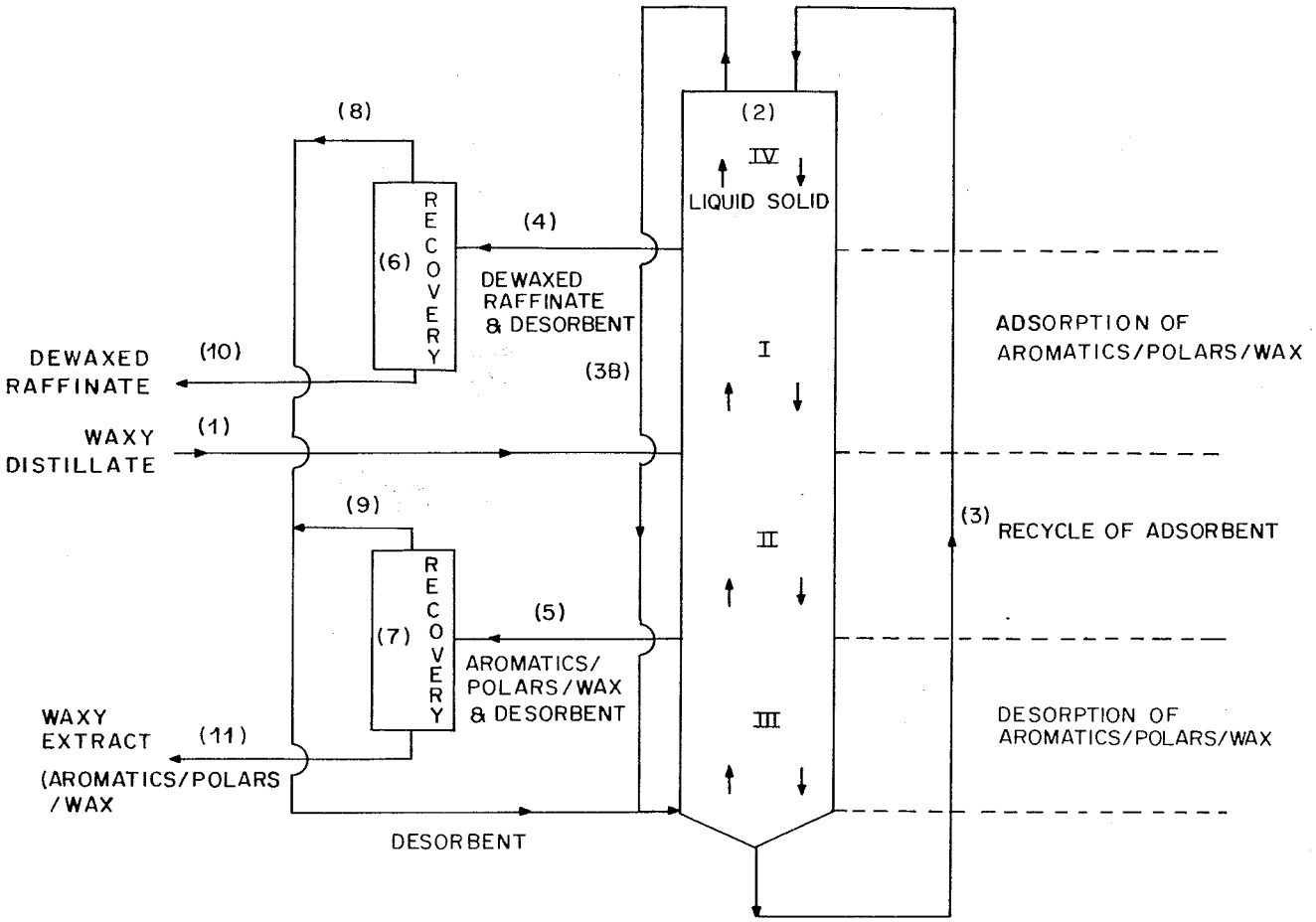
FIG. 1 is a schematic of a magnetically stabilized bed (MSB) employing the simultaneous aromatic/polar/-wax adsorption, adsorbent regeneration using a common desorbent procedure of the present invention.

It has been discovered that oil distillates which contain wax and aromatics/polar contaminants can have their wax and aromatic/polar contaminant levels reduced in a simultaneous adsorption process employing a combination adsorbent comprising a large-pore polar adsorbent and a hydrophobic molecular sieve. The oil to be processed is contacted with this combination adsorbent under either a batch or continuous basis, continuous countercurrent contacting being preferred.

The continuous countercurrent process can employ either a mixed bed of adsorbent in a single zone or staged, separate beds, one containing large pore polar adsorbent and the other containing a hydrophobic molecular sieve. Preferably, a single mixed bed is employed.

The large-pore polar adsorbent may be any amorphous silica-alumina material which preferentially adsorb polars/aromatics over saturates, such as Ketjen HA.

Thus, the large-pore polar adsorbent may be any of the silicas, aluminas or silica-aluminas having pore diameters from 10–1000 Å, silica/alumina ratio from 0.01 to 100, surface area from 10 to 600 $m^2/gm$ can be used.

The hydrophobic molecular sieve is a sieve type material, preferably having an $SiO_2/Al_2O_3$ ratio of 50:1 to 200:1 and greater, i.e., alumina free. This material has a pore size of about 5 to 7 Å, preferably 6 Å.

Hydrophobic molecular sieves include silicalite, Mobil ZSM type adsorbents, carbon molecular sieves, etc., so long as the sieve has a pore diameter of about 5 to 7 Å and the sieve surface has a low affinity for polar materials. Silicalite is just one of this type of adsorbent (the pore diameter is about 6 Å units and its pore volume is 0.19 cc/gm and particle density is about 1.4 g/cc). Silicalite is described in detail in U.S. Pat. No. 4,104,294 and U.S. Pat. No. 4,061,724 and in "Silicalite, a New Hydrophobic Crystalline Silica Molecular Sieve", Flanigan, et al., *Nature,* Volume 271, February, 1978, pages 512–516. The use of silicalite to remove a specific n-paraffin from mixtures of the same with branched and cyclic paraffins is demonstrated in U.S. Pat. No. 4,455,444. Any non-polar, non-acidic sieving material can probably be considered a hydrophobic molecular sieve. This includes zeolites, as well as non-zeolite materials (i.e., carbon moleculr sieve). However, there is a narrow range of pore openings (5–7 Å) considered to be useful for separating wax molecules from lube oils.

The two components, while they can be used in separate beds or as different zones within the same bed, are preferably used as a combined mixture. This preferred mixture contains from about 5 to 95 weight percent large-pore polar adsorbent, preferably 40 to 60 weight percent large pore polar adsorbent, the balance being hydrophobic molecular sieve.

The ratio of large-pore polar adsorbent to hydrophobic molecular sieve depends on the nature of the oil feed used and the separation targets required in aromatics removal and wax removal, respectively.

The oil distillate fed to this combination adsorbent is any distillate from any natural or synthetic source. The oil distillate can be any light or heavy distillate. For the heavier oils, such as the heavy distillates and especially Bright Stock, adsorption/desorption kinetics may become a concern. Higher operating temperatures may become necessary.

The oil distillate treated in this process can have been subjected to prior dewaxing and/or dearomatizing using conventional techniques; however, oil which has just been distilled without any further or intervening processing is the preferred feed as the present process can be employed to effect all the dewaxing and dearomatizing needed on the oil, thereby replacing the previously practiced conventional processing steps and thus effecting a substantial saving and simplification of the overall lube manufacturing-dewaxing/dearomatizing process.

The waxy/aromatic-polar component containing oil is contacted with the combined adsorbent for from 10 to 120 minutes, preferably 30 to 60 minutes.

The contact time can be affected by various parameters, i.e., adsorption temperature, adsorbent particle size, etc. There is no upper limit on contact time provided adsorption temperature is below that at which cracking may occur.

The aforesaid contacting is conducted at from 25° C. to 250° C., preferably 50° C. to 250° C., the upper limit on temperature being a temperature below that at which cracking occurs. Any pressure can be employed, pressures ranging from 15 to 250 psi being suitable.

Depending on feed composition and product specification, the oil/adsorbent ratio employed in this work can be varied in a wide range, e.g., from 0.5 to 20 volumes of oil can be treated per volume of adsorbent. Of course, from an economical viewpoint, the higher this ratio the better.

In Example I one sees that a given weight of distillate oil is contacted with an equivalent weight of regenerated polar adsorbent five times to achieve an aromatics content level equal to that of NMP extraction. Thus, if a 50/50 mix of polar adsorbent/sieve is used as the combined adsorbent it would take 2 weight units of combined adsorbent to treat one weight unit of oil (employing the same 5X contacting steps). In the above the total amount of polar adsorbent is kept constant.

The oil feed can be introduced as such to the combined adsorbent, or it can be mixed with a diluent.

The diluent is a non-polar solvent having a critical molecular diameter greater than the pore diameter of the sieve adsorbent (i.e., 5 to 7 Å). The boiling point of the diluent should be quite different from that of the oil products and preferably also different from the desorbents (mentioned later). Preferably, the diluent is highly miscible with oil and wax. Diluents which meet these requirements include heptane, iso-octane, neo-pentane, other branched chain alkanes containing from 5 to 20 carbons and cycloparaffins. Diluents of the size of isooctane and larger are needed when both aromatic/polar and waxes are to be simultaneously adsorbed.

From 0.5 to 5 volumes of diluent may be used for each volume of oil.

This diluent is also preferably the large molecular diameter, non-polar solvent which is employed as a co-component along with a polar solvent as the desorbent, described in greater detail below.

By contacting the oil feed with the combined adsorbent, wax and aromatics/polars are adsorbed by the combined adsorbent. The non-adsorbed oil containing less wax and aromatics/polars than the feed is then separated from the wax/aromatics-polar component-laden adsorbent by any separation technique, such as by settling-decantation, centrifuging, filtering, etc. If a countercurrent procedure is employed the direction of the flow of the solid and liquid streams necessarily effects the desired separation.

Alternatively, after adsorption the wax-laden adsorbent is separated from the dewaxed oil, the adsorbent is washed with a wash solvent selected from the aforementioned diluents to remove/recover any trapped oil and the adsorbent regenerated. Even $N_2$ or steam purge can be used for removing oil trapped in the adsorbent bed, though this is not preferred as it introduces the necessity of practicing additional steps. If steam purge is used the adsorbent must be subjected to a drying step before reuse since the large-pore polar adsorbent exhibits a large affinity for water.

Temperature and pressure used in washing are the same as that used in the adsorption step. Amount of wash solvent may not be critical, just enough being employed to remove the trapped oil.

The contaminated adsorbent is regenerated, i.e., flushed of adsorbed wax and aromatics/polars, by use of a desorbing solvent. The desorbing solvent comprises a polar solvent (having a molecular diameter smaller than the micropore diameter of the hydrophobic molecular sieve employed, i.e., smaller than 5 to 7 Å) in combination with a small quantity of (if any) large molecular diameter non-polar solvent, such as the aforementioned isooctane.

Desorption is conducted at a temperature of from 25° C. to 250° C., preferably 50° C. to 150° C., a pressure of 15 to 150 psig, and for a time of 15 to 120 minutes, the comments made concerning temperature, pressure and time above for the adsorption step being equally true and applicable here.

The adsorbent is contacted with from 1 to 20 volumes of desorbing solvent per volume of adsorbent.

The combined desorbent solvent containing polar solvent (such as dichloromethane (DCM) or MEK) and large molecular diameter non-polar solvent (such as the aforementioned diluents, e.g., isooctane) may contain from 5 to 100 weight percent polar solvent, the balance being non-polar solvent.

Preferably, the combined desorbent solvent contains 50 to 100 weight percent polar solvent. It is preferred that the desorbent solvent contain a high concentration of the active desorbing component, which is the polar solvent. Thus, it is preferred that the non-polar solvent used as diluent during the adsorption step contain as little polar solvent as possible, while, conversely, it is desirable that the polar solvent used as the desorbent during the regeneration step contain as little non-polar solvent as possible. In a batch adsorption process a significant amount of unadsorbed oil (hold-up oil) is trapped in the non-selective voids of the adsorbents. In order to maximize the oil product yield an inert liquid (a large-diameter non-polar solvent, such as isooctane, or any of the aforementioned diluents) is used to wash the adsorbent bed between the adsorption and desorption cycles and, therefore, its presence in the desorption step can be kept at a minimum. In a continuous countercurrent adsorption process the desorbent (i.e., dichloromethane) displaces both adsorbent species (i.e., wax and aromatic/polar species) and hold-up oil in both selective adsorption pores and non-selective voids. Therefore, the amount of the large diameter non-polar solvent/diluent may be reduced or preferably even eliminated in the combined desorbent solvent.

A countercurrent continuous adsorption process is preferred for the present invention. In principle the continuous countercurrent adsorption process requires much less adsorbent and desorbent as compared to a batch operation. The countercurrent contact of solid adsorbent and liquid streams can be achieved by a truly moving bed, i.e., magnetically stabilized bed, such as described in U.S. Pat. Nos. 4,115,927 and 4,497,987, or simulated moving bed, such as described in U.S. Pat. Nos. 3,040,777 and 3,192,954, the disclosures of which are incorporated herein by reference.

A magnetically stabilized bed adsorption process is used to illustrate the invention as shown in FIG. 1. Waxy distillate (1) is introduced to the adsorber (2) in which the solid adsorbent is conveyed continuously down through the bed and countercurrently contacted with the rising liquid streams. The adsorber is initially charged with a mixture of a large pore, polar adsorbent and a hydrophobic molecular sieve as the adsorbent system. The adsorber consists of four zones.

Waxy distillate enters Zone I in which aromatics/polars and wax species are simultaneously and selectively adsorbed by the absorbent system and produces a stream of dewaxed raffinate plus desorbent as withdrawn product (raffinate solution) from the top of Zone I.

Zone II is primarily for rectifying the raffinate. The liquid entering the bottom of this zone contains only aromatics/polars and wax, plus desorbent. As the solid descends, the weakly adsorbed non-wax saturate (oil) is gradually desorbed from the solid by the rising liquid stream of aromatics/polars and wax (which are subsequently readsorbed in Zone I and descend again) plus desorbent.

Zone III is a desorption zone which serves to remove the strongly adsorbed aromatics/polars and wax components from the adsorbent. The solid entering Zone III carries aromatics, wax and desorbent as adsorbed components. Liquid entering the bottom contains only desorbent. As the solid descends the adsorbed components are gradually desorbed from the adsorbent by the action of the desorbent solvent and removed from the top of Zone III as withdrawn product (extract solution).

Zone IV serves as the locale wherein a portion of the desorbent which is trapped in the non-selective voids of the adsorbent solid entering Zone IV is removed therefrom by a rising system of liquid containing non-waxy saturates or by other mechanical means. Desorbent thus removed from the solid then flows into Zone III via line 3(B) where it functions as the desorbent. A slip stream of desorbent drawn from Zone IV can be used to lift the adsorbent back to the adsorber via line (3).

Raffinate solution and extract solution exit adsorber via lines (4) and (5) to raffinate/solvent and extract/solvent recovery units (6) and (7), respectively. Solvent from the raffinate and extract recovery units are combined and recycled to the adsorber via lines 8 and 9. Dewaxed raffinate and waxy extract exit the raffinate and extract recovery units, respectively, via lines (10) and (11).

A preferred embodiment is shown in FIG. 2. In this embodiment desorbent-rich solvent is recovered from the adsorption tower (2) and flash unit (2A) via line (12). Raffinate solution and extract solution via lines (4) and (5), respectively, are sent to flash units (6A) and (7A), respectively, before being fed to standard solvent recovery units (6) and (7). In the flash units the more volatile desorbing solvent (such as dichloromethane) is separated from the extract and raffinate and this desorbent-rich solvent is recovered via lines (12A) and (12B), combined with the desorbent-rich solvent in line (12) and fed via line (12) back into Zone III of adsorbent tower (2). Desorbent-lean solvent is recovered from standard recovery zones (6) and (7) via lines (8) and (9) and from flash unit (2A) bottom via line (13A) and fed via line (13) to the adsorbent recycle line (3) wherein the desorbent-lean solvent (i.e., the isooctane diluent) is used to render the adsorbent more manageable. Diluent containing the least concentration of desorbent is preferred.

Figure 3:
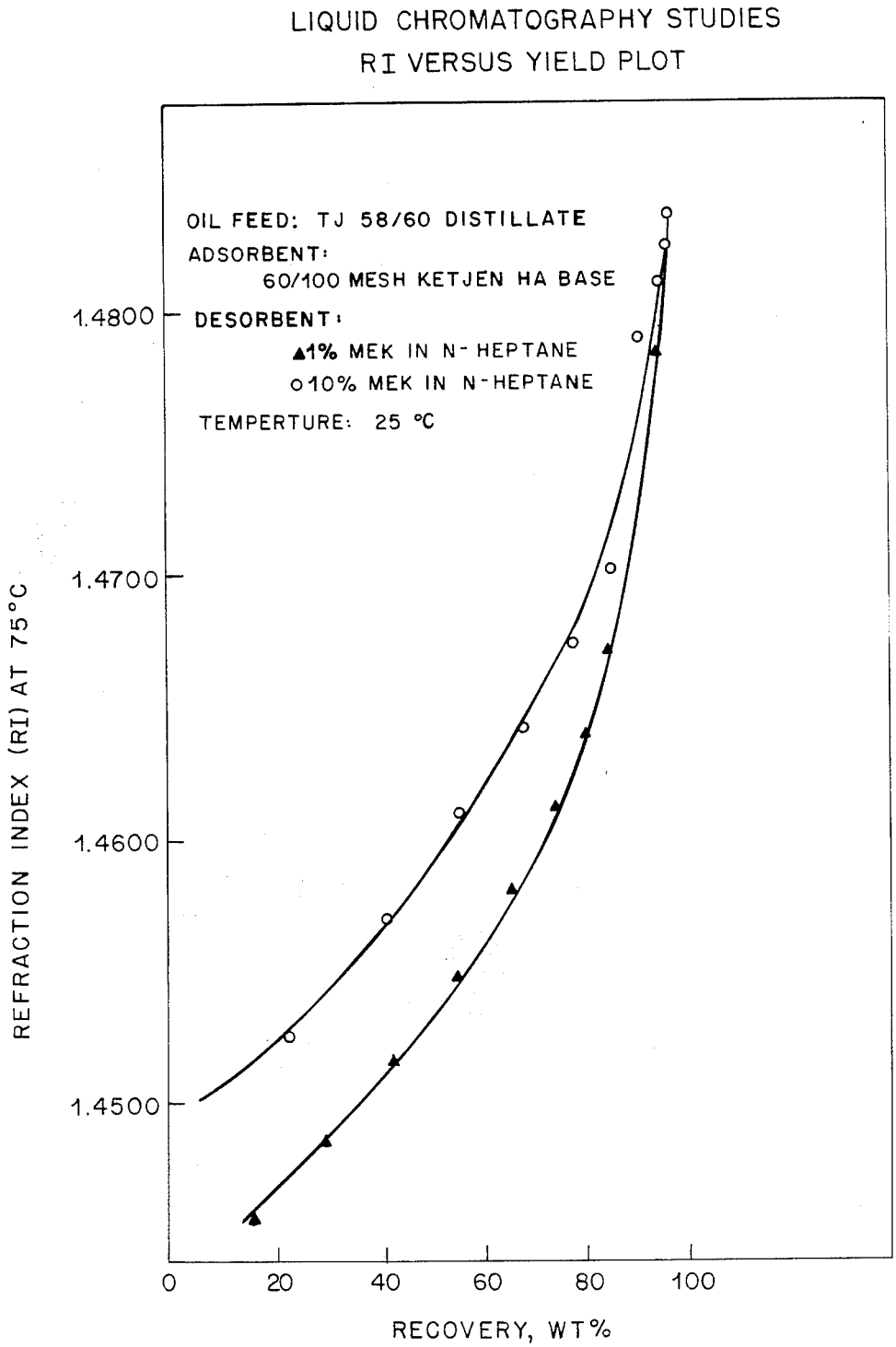
FIG. 3 shows that adsorption is best practiced when the diluent contains the least desorbent.

The above statement is supported by the liquid chromatography studies using Ketjen HA base as the adsorbent and MEK in n-heptane as the desorbent system. The results shown in FIG. 3 indicate that, for a given yield, raffinate produced with 1% MEK in n-heptane in the adsorption zone had a lower refractive index (RI) (better separation of aromatics and saturates) than that made with 10% MEK in n-heptane. To achieve a certain separation level a larger amount of adsorbent would be required if a higher concentration of MEK (e.g., desorbent) is present in the diluent while adsorption is occurring.

EXAMPLES

I. Removal of Aromatics/Polars

The effectiveness of a large pore, polar adsorbent (i.e., Ketjen high alumina base) for the separation of aromatics and saturates from dewaxed lube distillate has been demonstrated in batch studies (Table I). A solvent dewaxed North Sea (Brent system Mix) 150N distillate (dewaxing conditions: 60/40 MEK/MIBK, 3/1 solvent-/oil, −12° C. filter temperature) was treated with Ketjen HA using n-heptane as a diluent at 50° C. for 1 hour. The weight ratio of oil to adsorbent to diluent was 1:1:1. Following the adsorption step the aromatics-loaded adsorbent was regenerated with methyl-ethyl ketone at 50° C. for 1 hour and then dried in vacuum oven at 100° C. for 16 hours. Raffinate oil containing diluent after separation from the adsorbent was then recontacted with the regenerated adsorbent under the same adsorption conditions. The same procedures were repeated until the final oil met base-stock VI target. Results shown in Table I indicate that after 5 treatments adsorbent-treated raffinate matched the NMP-extracted raffinate in most physical properties including VI. However, the adsorbent treated oil had much lower nitrogen content and much better color than the solvent extracted oil. It was also noted that while the saturates distribution was relatively unchanged in the Ketjen HA treatment, relative to NMP extraction, Ketjen HA treating is more selective for mono-ring aromatics removal.

In a separate study it was found that replacing n-heptane with isooctane as diluent in the system has no effect on aromatics/saturates separation with Ketjen HA base. The small diameter n-heptane can be used when only aromatics/polars are to be adsorbed. However, when both aromatics/polars and wax are to be removed from the distillate large diameter, non-polar solvents (i.e., isooctane) must be employed, that is, the diluent must possess a kinetic diameter larger than that of the hydrophobic molecular sieve adsorbent (i.e., 5 to 7 Å). The use of diluents of smaller diameter could interfere with wax adsorption in the molecular sieve.

TABLE I

| | Feed(1) | Adsorbent Treated | NMP Extracted |
|---|---|---|---|
| RI @ 75° C. | 1.4826 | 1.4627 | 1.4619 |
| Density, g/c.c. | 0.9048 | 0.8762 | 0.8157 |
| Viscosity @ 40° C. CSt | 39.69 | 28.89 | 30.10 |
| Viscosity @ 100° C., CSt | 5.62 | 4.97 | 5.08 |
| VI | 69 | 94 | 93 |
| Pour Point, °C. | −9 | −6 | −9 |
| Color, ASTM | 2.0 | <0.5 | <2.0 |
| Total Nitrogen, ppm | 310 | <1 | 76 |
| Basic Nitrogen, ppm | 230 | <1 | 71 |
| Sulphur, Wt. % | 0.56 | 0.18 | 0.24 |
| Saturates, Wt. % | 57.8 | 76.4 | 74.5 |
| (% distribution) | | | |
| Paraffins | 17.2(29.8) | 23.2(30.3) | |
| 1-ring | 15.3(26.4) | 20.9(27.3) | |
| 2+ ring | 25.3(43.8) | 32.4(42.4) | |
| Aromatics/Polars, Wt. % | 39.9 | 23.3 | 24.8 |
| (% Distribution) | | | |
| Mono-Ring | | | |
| Alkyl Benzenes | 8.6(21.7) | 72.(30.8) | 8.1(32.7) |
| Naphtheno Benzenes | 11.4(28.6) | 8.1(34.7) | 9.5(38.3) |
| 2-Ring | 11.1(27.9) | 5.5(23.5) | 5.4(21.8) |
| 3+ Ring | 6.8(17.0) | 1.5(6.4) | 0.9(3.6) |

Adsorption Conditions: Regenerated Ketjen HA base as adsorbent, 50° C. 1 hour, weight ratio oil/adsorbent/n-$C_7$ = 1/1/1, five treatments
Regeneration Conditions: 50° C., weight ratio oil/MEK = 1/2, MEK washed adsorbent dried in vacuum oven (100° C.) for 16 hours
(1)North Sea 150N solvent dewaxed distillate. Dewaxing conditions: MEK/MIBK ratio = 60/40; solvent/oil ratio = 3/1; filter temperature = −12° C.

II. Removal of Wax

Table II shows that silicalite (an alumina-free hydrophobic molecular sieve) is effective for the removal of wax from waxy raffinate. A 36° C. reduction in pour point of a Western Canadian 150N waxy raffinate is achieved with silicalite after six treatments using isooctane as diluent (silicalite to oil weight ratio=40/100 in each treat) while after eight treatments a 42° C. reduction in pour point was achieved. The waxy raffinate used in this Example was NMP extracted prior to adsorptive dewaxing. The silicalite was not regenerated between adsorption cycles in the Example of Table II; fresh silicalite was used in each cycle.

Various solvents were evaluated for their effectivenss in regenerating the wax loaded silica-lite. Several adsorption/regeneration cycles were conducted using the same oil feed. Results shown in Table III indicate that while MEK is effective for removing wax from silicalite at 80° C. it is inferior to dichloromethane (DCM) at 25° C. Toluene, having a kinetic diameter greater than 6.8 Å, is ineffective for removing wax from silicalite (pore diameter of about 6 Å).

TABLE II

REMOVAL OF WAX FROM WAXY RAFFINATE USING SILICALITE

| Number of Treatments | — | 1 | 2 | 3 | 4 | 5 | 6 | 7 | 8 |
|---|---|---|---|---|---|---|---|---|---|
| RI @ 75° C. | 1.4548 | 1.4558 | 1.4568 | 1.4578 | 1.4588 | 1.4599 | 1.4606 | 1.4610 | 1.4612 |
| Pour Point, °C. | 33 | — | 30 | — | 21 | 9 | −3 | −6 | −9 |
| Wescan Cloud Point, °C. | 36 | 34 | 32 | 31 | 23 | 12 | 0 | −4 | −6 |
| Wt. % Oil Recovered (Unabsorbed) From Adsorbent | — | 96.2 | 96.0 | 96.2 | 96.2 | 96.3 | 96.8 | 98.0 | 99.0 |

Feed = Western Canadian 150N Waxy Raffinate
Adsorption Conditions: Silicalite/Oil Weight Ratio = 40/100; oil/isooctane weight ratio = 1/1; 100° C., 1 hour.

TABLE III

REGENERATION OF WAX-LOADED SILICALITE WITH VARIOUS SOLVENTS

| Desorbent | Feed A | MEK(1) | | | MEK(2) | | | DCM(2) | | | Toluene(2) |
|---|---|---|---|---|---|---|---|---|---|---|---|
| Regeneration Temperature °C. | — | 80 | | | 25 | | | 25 | | | 25 |
| Number of Cycles | — | 2 | 3 | 4 | 2 | 3 | 4 | 2 | 3 | 4 | 1 |
| Pour Point, °C. | −6 | −9 | −9 | −9 | −9 | −6 | −6 | −12 | −12 | −12 | −6 |

A Solvent dewaxed Western Canadian 150N Base Oil
(1)Adsorption Conditions: Silicalite/oil weight ratio = 20/100; oil/isooctane weight ratio = 1/1; 100° C. for 16 hours.
Regeneration Conditions: 80° C., Under Reflux With MEK for 16 hours; MEK/Silicalite Weight Ratio = 5/1.
(2)Adsorption Conditions: Silicalite/Oil Weight Ratio = 30/100; Oil/Isooctane Weight Ratio = 1/1; 100° C., 1 hour.
Regeneration Conditions: 25° C., Solvent/Silicate Weight Ratio = 10/1, 1 hour.

Toluene was tested at 80° C. for silicalite regeneration but it did not work (adsorption with toluene regenerated silicalite showed no drop in oil pour point).

The increase in pour point for the third and fourth adsorption cycles indicated that MEK regeneration at 25° C. is ineffective. At higher temperatures (80° C.), MEK behaves better, but still not as well as DCM at 25° C., Thus, DCM appears to be the most effective desorbent evaluated for removing wax from silicalite. DCM desorption at 80° C. was not attempted (due to equipment limitation, DCM boils at 40° C.), but it is believed that a higher temperature desorption, as long as the desorbent is in the liquid state (in the case of DCM, a moderate pressure would be required to maintain DCM in the liquid state) should be effective for desorbing wax from silicalite.

TABLE IV

EFFECT OF AROMATICS IN FEED ON ADSORPTION OF WAX WITH SILICALITE

| | Wt. % Extract Added to Partially Dewaxed Waxy Raffinate | | | | | |
|---|---|---|---|---|---|---|
| | 0 | | 10 | | 20 | |
| | Feed | Product | Feed | Product | Feed | Product |
| RI, 75° C. | 1.4600 | 1.4608 | 1.4661 | 1.4670 | 1.4722 | 1.4732 |
| Pour Point, °C. | −6 | −15 | −3 | −12 | 0 | −12 |

TABLE IV-continued

EFFECT OF AROMATICS IN FEED ON ADSORPTION OF WAX WITH SILICALITE

| | Wt. % Extract Added to Partially Dewaxed Waxy Raffinate | | | | | |
|---|---|---|---|---|---|---|
| | 0 | | 10 | | 20 | |
| | Feed | Product | Feed | Product | Feed | Product |
| Wescan Cloud Point, °C. | −1 | −11 | −1 | −12 | −1 | −12 |
| Viscosity @ 40° C., CSt | 28.12 | — | 30.55 | 32.11 | 33.30 | 35.10 |
| Viscosity @ 100° C., CSt | 4.89 | — | 5.03 | 5.17 | 5.18 | 5.30 |
| VI | 94 | — | 85 | 85 | 77 | 74 |

Adsorption Conditions: Silicalite/Oil Weight Ratio = 30/100; Oil/Isooctane Weight Ratio = 1/1; 100° C. 1 hour.

TABLE IVA

EFFECT OF WAX IN FEED ON ADSORPTION OF AROMATICS WITH KETJEN HA BASE

| | North Sea 150N Distillate | North Sea 140N Distillate |
|---|---|---|
| Wax in Feed, Wt. % | 2.5 | 15.6 |
| Aromatics in Feed, Wt. % | 41.0 | 35.8 |
| Oil/Ketjen HA Wt. Ratio | 1/2.5 | 1/2.5 |
| Aromatics/Desorbent, DCM/Isooctane Wt. Ratio | 1/3.5/29 | 1/3.7/33 |
| Yield, Wt. % | 89.2 | 92.1 |
| Aromatics Removal, Wt. % | 25 | 23 |

III. The Presence of Aromatics (or Wax) in Feed Has No Adverse Effect on Adsorption of Wax (or Aromatics)

In the present invention aromatics and wax are simultaneously adsorbed on the two different type adsorbents during the adsorption step. It is important that the presence of aromatics (or wax) in feed have no adverse effect on adsorption of wax (or aromatics). Results shown in Table IV indicate that addition of up to 20 weight percent of a lube extract derived by NMP extraction of a Western Canadian 150N distillate (>90% aromatics) to partially dewaxed lube raffinate (−6° C. pour dewaxed from the aforementioned distillate) did not affect the performance of silicalite for wax removal. It was also proved (see Table IVA) that the presence of wax in feed has no adverse effect on the performance of Ketjen high alumina base for aromatics removal.

IV. The Presence of Aromatics (or Wax) in Desorbent Has No Adverse Effect on Desorption of Wax (or Aromatics)

In the present invention a common desorbent system (e.g., DCM in isooctane) is used for removing both aromatics and wax from the adsorbent system during the regeneration step. It is important that the effectiveness of the desorbent for the removal of wax (or aromatics) is not degraded by the presence of aromatics (or wax) in the desorbent. Results shown in Table V indicate that addition of up to 10 weight percent 150N extract to (150N extract is >90% aromatics) DCM (no cosolvent present) did not affect the performance of the DCM for desorbing wax from silicalite.

TABLE V

EFFECT OF PRESENCE OF AROMATICS IN DCM ON REGENERATION OF WAX-LOADED SILICALITE

| Concentration of 150N Extract in DCM (in Wt. %) | Feed | 0 | 5 | 10 |
|---|---|---|---|---|

TABLE V-continued

EFFECT OF PRESENCE OF AROMATICS IN DCM ON REGENERATION OF WAX-LOADED SILICALITE

| Pour Point, °C. | −6 | −12 | −12 | −12 |
|---|---|---|---|---|

Adsorption Conditions: Use DCM (with or without extract) to regenerate silicalite. Silicalite/Oil Weight Ratio = 30/100; 100° C., 1 hour.
Regeneration Conditions: 25° C., DCM/Silicalite Weight Ratio = 10/1, 1 hour. Silicalite dried at about 25° C. at 200 mm Hg vacuum on filter.

V. Combination Adsorbent Consisting of Ketjen HA and Silicalite Simultaneously Remove Wax and Aromatics Table VI presents data wherein a North Sea 140N distillate waxy feed was simultaneously dewaxed and dearomatized using a combination adsorbent within the scope of this invention. The combined adsorbent was a mixture of Ketjen HA and silicalite used in a weight ratio of 1.7/1.

The North Sea 140N waxy distillate feed was batch slurry treated with fresh adsorbents at 80° C. using a 1/1.1/1.7 weight ratio of oil/adsorbent/isooctane. After removing the oil, the aromatics and wax loaded adsorbents were regenerated with DCM at 25° C. using a 2.6/1 weight ratio of DCM/adsorbent. Adsorbents were dried at about 25° C., 200 mmHg vacuum during filtration. The DCM regenerated adsorbents were then used again to process the oil obtained from the previous step. The same procedures were repeated six times until the final oil met the basestock VI and pour point targets.

Results shown in Table VI indicate after six treatments a basestock having 94 VI and −3° C. pour was made. The slightly higher pour of the adsorbent treated oil can easily be reduced to −9° C. by adding more silicalite or using a higher ratio of silicalite to Ketjen HA base. This was proved in lab studies. A comparison of properties of basestocks derived from the combined adsorption process and conventional lube process (Table VI) indicates that the adsorption-produced basestock has much lower basic nitrogen content, which is very desirable.

This data demonstrates that both adsorbent components can be employed simulaneously to effect dewaxing and dearomatizing and a single common desorbent can be used to regenerate the adsorbents, thereby simplifying the overall dewaxing/dearomatizing process. The combined adsorption process is compared to conventional lube processes.

The conventional dewaxed/extracted North Sea 140N oil was produced as described below:

Solvent Extraction/Dewaxing of BSM 140N Distillate

Extraction Conditions

-continued

| Solvent Extraction/Dewaxing of BSM 140N Distillate | |
|---|---|
| Solvent | NMP |
| Temperature, °C. (Top/Bottom) | 65/55 |
| Water in Solvent, LV % | 2.2 |
| Treat, LV % | 129 |
| Dewaxing Conditions | |
| Solvent | MEK/MIBK (40/60) Vol/Vol |
| Solvent/Oil Ratio (by Vol) | 2.5/1 |
| Filtration Temperature, °C. | −13 |

TABLE VI

ADSORBENTS CAN SIMULTANEOUSLY REMOVE AROMATICS AND WAX FROM LUBE DISTILLATE

| | Feed (North Sea 140N) Waxy Distillate | Adsorption(1) (North Sea 140N) Waxy Distillate | Conventional Lube Process NMP Extraction of Dewaxed North Sea 140N Oil |
|---|---|---|---|
| Viscosity @ 40° C., CSt | — | 29.85 | 30.10 |
| VI | 67 (DWO)A | 94 | 94 |
| Pour Point, °C. | +33 | −3 | −9 |
| Color, ASTM | 7.5 | <0.5 | <2.0 |
| Basic Nitrogen, ppm | 197 | Nil | 55 |
| Sulphur, Wt. % | 0.52 | 0.17 | 0.22 |
| Saturates, Wt. % | 62.7 | 77.8 | 76.8 |
| Aromatics/Polars, Wt. % | 34.9 | 22.1 | 21.5 |

(1)Adsorption Conditions: Regenerated Ketjen HA/silicalite (1.7/1) as adsorbent, 80° C., 2 hours, weight ratio of oil/adsorbent/isooctane = 1/1.1/1.7, six treatments.
Regeneration Conditions: 25° C., weight ratio of DCM/adsorbent = 2.6/1 DCM washed adsorbents were dried at about 25° C. at 200 mmHg vacuum in filtration
A Viscosity index of feed BSM 140N taken of a dewaxed sample of the oil.

VI. Quality of Adsorbent Treated Basestock

Oxidation stability test results shown in Table VII indicate that the quality of Ketjen HA base treated basestock is better than that produced by the conventional NMP extraction process.

TABLE VII

OXIDATION STABILITIES OF KETJEN HA TREATED NORTH SEA 150N VERSUS NMP EXTRACTED NORTH SEA 150N

| | Ketjen HA Treated 94 VI Raff. | NMP Extracted 95 VI Raff. |
|---|---|---|
| Uninhibited Stability | | |
| IP 306 (Cu catalyst) Total Oxidation Product, Wt. % | 0.54 | 1.69 |
| Inhibited Stability | | |
| D2440 (0.1 Wt. % DBPC) | | |
| Induction Period, Hours | 150 | 42 |
| Total Acid No. (TAN) mgKOH/g (Hours) | 0.36(350) | 1.57(164) |
| Nuto Formulation | | |
| RBOT Life, Minutes | 304 | 329 |
| Staeger, Hours to Δ Tan = 0.2 | 1066 | 300 |
| D943, Hours to Δ TAN = 2.0 | 2146 | 1000 |

VII. Performance of Polar Adsorbent (Ketjen HA) Not Affected by Presence of Sieve Adsorbent (Silicalite) and Vice Versa North Sea 140N waxy distillate was batch slurry treated with various adsorbents, namely Ketjen HA, silicalite and a mixture of Ketjen HA and silicalite. Results shown in Table VIII indicate that performance of Ketjen HA (polar adsorbents for aromatics removal) is not affected by the presence of silicalite (sieve adsorbent for wax removal) and vice versa.

TABLE VIII

PERFORMANCE OF KETJEN HA IS NOT AFFECTED BY THE PRESENCE OF SILICALITE AND VICE VERSA

| | Feed Oil - North Sea 140N Waxy Distillate | | | |
|---|---|---|---|---|
| Treating Conditions, Wt. Ratio(1) Oil/Desorbent, DCM/Isooctane | 1/1.2/10.5 | | | |
| Oil/Adsorbent | | | | |
| Ketjen HA | — | 1/2.5 | — | 1/2.5 |
| Silicalite | — | — | 1/2.5 | 1/2.5 |
| Yield, Weight % | 100 | 92.1 | 85.0 | 74.5 |
| Composition, Weight % | | | | |
| Non-Waxy Saturates | 48.67 | 52.77 | 57.23 | 63.09 |
| Aromatics | 35.76 | 29.79 | 41.32 | 34.29 |
| Wax | 15.57 | 17.44 | 1.45 | 2.62 |
| Aromatics Removal, Weight % | 0 | 23 | 0 | 29 |
| Wax Removal, Weight % | 0 | 0 | 92 | 88 |

(1)25° C., 2 Hours Slurry Mixing

VIII. Adsorption Produces Acceptable Paraffinic Transformer Oil in a Single Step Tables IX, IXA and X present a comparison of the present simultaneous adsorption process against conventional dewaxing and extraction of paraffinic transformer oil distillates. Adsorption produces a transformer oil of low pour and very low basic nitrogen content, as well as acceptable aromatics content level, whereas conventional systems cannot meet low nitrogen levels without further processing. Thus, simultaneous adsorption replaces separate solvent dewaxing, aromatics extraction and nitrogen removal procedures with a single processing procedure.

It is seen that relative to solvent dewaxing silicalite adsorption is more selective for paraffins removal. Similarly, as compared to solvent extraction, Ketjen HA adsorption is more selective for mono-ring aromatics removal.

The conventionally dewaxed and extracted stream shown for comparison was produced employing the following procedures:

| Solvent Extraction/Dewaxing of North Sea 60N Distillate | |
|---|---|
| Extraction Conditions (Countercurrent) | |
| Solvent | NMP |

-continued

| Solvent Extraction/Dewaxing of North Sea 60N Distillate | |
|---|---|
| Temperature, °C. (Top/Bottom) | 54/42 |
| Water in Solvent, LV % | 7.7 |
| Treat, LV % | 93 |
| Dewaxing Conditions | |
| Solvent | MEK/MIBK (70/30) Vol/Vol |
| Solvent/Oil Ratio (by volume) | 2.5/1 |
| Filtration Temperature, °C. | −37 |

TABLE IX

ADSORPTION FOR PARAFFINIC TRANSFORMER OIL

| | Feed (North Sea 60N) Waxy Distillate | Adsorption(1) | Conventional Lube Process |
|---|---|---|---|
| Viscosity @ 40° C. | 7.78 | 8.38 | 8.79 |
| Basic Nitrogen, ppm | 76 | <1 | 49 |
| Total Nitrogen, ppm | 230 | <1 | 56 |
| Sulphur, Wt. % | 0.90 | 0.41 | 0.55 |
| Cloud Point, °C. | +11 | −26 | −28 |
| Pour Point, °C. | +9 | −30 | −33 |
| Aromatic Carbon, Wt. % | 16.7 | 9.8 | 10.1 |
| Pour Point, °C. | +9 | −30 | −33 |
| Saturates, Wt. % (% Distribution) | 71.1 | 78.8 | 75.2 |
| Paraffins | 37.6 (53.0) | 27.8 (35.3) | 28.5 (37.9) |
| Non-Cond. Cyclo-Paraffins | 19.4 (27.3) | 30.3 (38.5) | 27.7 (36.8) |
| Cond. Cyclo-Paraffins | 14.0 (19.7) | 20.6 (26.1) | 19.0 (25.3) |
| Aromatics, Wt. % (% Distribution) | 28.9 | 21.2 | 24.8 |
| Mono-Ring | | | |
| Alkyl Benzenes | 6.6 (22.8) | 6.7 (31.6) | 8.3 (34.3) |
| Naphtheno Benzenes | 7.5 (25.9) | 6.9 (32.6) | 8.5 (34.3) |
| 2-Ring | 8.0 (27.7) | 4.4 (20.8) | 5.0 (20.2) |
| 3+ Ring | 3.4 (11.8) | 1.5 (7.1) | 1.5 (6.1) |
| Thiopheno | 3.3 (11.4) | 1.6 (7.5) | 1.3 (5.2) |

(1)Ratio of Ketjen HA/silicalite = 1.5/1; adsorption conditions: oil/adsorbent/isooctane weight ratio = 1/1.3/1.3; 80° C., 2 hours, six treatments. Regeneration conditions: weight ratio of DCM/adsorbent = 2.6/1; 2 hours; 30° C. DCM washed adsorbents were dried at about 25° C. at 200 mmHG vacuum in filtration.

TABLE IXA

SIMULTANEOUS REMOVAL OF AROMATICS AND WAX FROM PARAFFINIC TRANSFORMER OIL DISTILLATE BY ADSORPTION

| | Feed (Western Canadian 60N) Waxy Distillate | Adsorption(1) | Conventional(2) Lube Process |
|---|---|---|---|
| Viscosity @ 40° C. cSt | 6.88 | 7.79 | 7.94 |
| Basic Nitrogen, ppm | 97 | <1 | 39 |
| Sulphur, Wt. % | 0.38 | 0.11 | 0.20 |
| Pour Point, °C. | 4 | −51 | −39 |
| Aromatic Carbon, Wt. % | 18.5 | 9.6 | 9.9 |
| Mass Spec Analysis, Wt. % | | | |
| Saturates | 70.4 | 83.7 | NA |
| Aromatics | 29.6 | 16.3 | NA |

(1)Weight Ratio of Ketjen HA/Silicalite = 1.2/1;
Adsorption Conditions: Weight ratio of oil/adsorbent/isooctane = 1/0.9/1, 80° C. 2 hours, seven treatments
Regeneration Conditions: Weight ratio of DCM (desorbent)/adsorbent = 2.6/1, 30° C., 2 hours. DCM-washed adsorbents were dried at about 25° C. at 200 mm Hg vacuum in filtration.
(2)Extraction Conditions (Batch) Solvent: NMP. Temperature: 50° C. $H_2O$ in solvent = 3.5 Wt. %. Treat = 4 × 35 LV %. Dewaxing Conditions: Solvent: MEK/MIBK (70/30). Solvent/Oil Ratio = 2.5/1. Filtration Temperature = −37° C.

TABLE X

A COMPARISON OF PERFORMANCE OF PARAFFINIC TRANSFORMER OILS

| Oxidation Stabilities | Adsorption(1) | Conventional Processing(1) |
|---|---|---|
| 164 hour D2440 (0.08% DBPC) | | |
| Volatile Acids, mg KOH/g | Nil | 0.95 |
| Induction Period, Hour | >164 | 16 |
| Brockfield Viscosity, | 1364 | Too Viscous |

TABLE X-continued

A COMPARISON OF PERFORMANCE OF PARAFFINIC TRANSFORMER OILS

| Oxidation Stabilities | Adsorption(1) | Conventional Processing(1) |
|---|---|---|
| cPs @ −40° C. | | to measure(2) |

(1)Both oils were made from a Western Canadian 60N waxy distillate. Processing conditions are shown in Table IXA.
(2)In addition to oxidation inhibitor (0.08% DBPC), 0.07% Pearsell (pour depressant) was also added to the oil.

What is claimed is:

1. A method for simultaneously removing wax and aromatic/polar materials from oil distillates comprising contacting the oil distillate with a combined adsorbent comprising a mixture of a hydrophobic molecular sieve which is a non-polar non-acidic sieve material having a pore diameter of about 5 to 7 Å and a large-pore polar adsorbent, said large-pore polar adsorbent being selected from silica, alumina, silica-aluminas having pore diameters of from 10 to 1000 Å, silica to alumina ratios of from 0.01 to 100 and surface area of from 10 to 600 $m^2$/gram wherein the large pore polar adsorbent constitutes from 5 to 95 weight percent of the combined adsorbent mixture.

2. The method of claim 1 wherein the hydrophobic molecular sieve has a silica to alumina ratio of 50:1 to more than 200:1 and has a pore size of about 5 to 7 Å.

3. The method of claim 2 wherein the large-pore polar adsorbent is an amorphous silica-alumina and the hydrophobic molecular sieve is silicalite.

4. The method of claim 3 wherein the adsorption is conducted at a temperature between about 25° C. to 250° C. and at a pressure between atmospheric to about 250 psi.

5. The method of claim 1, 2, 3 or 4 wherein the oil to be contacted with the adsorbent is diluted prior to the contacting step with a non-polar solvent having a critical molecular diameter greater than the pore diameter of the hydrophobic molecular sieve.

6. The method of claim 5 wherein from 0.5 to 5 volumes of diluent is used for each volume of oil.

7. The method of claim 1, 2, 3 or 4 further comprising the step of separating the oil from the adsorbent, washing the adsorbent to remove oil trapped in the adsorbent and regenerating the adsorbent by washing same using a desorbing solvent comprising a mixture of polar solvent having a molecular diameter smaller than the micropore diameter of the hydrophobic molecular sieve component of the adsorbent and a large molecular diameter non-polar solvent.

8. The method of claim 5 further comprising the step of separating the oil from the adsorbent, washing the adsorbent to remove oil trapped in the adsorbent and regenerating the adsorbent by washing same using a desorbing solvent comprising a mixture of polar solvent having a molecular diameter smaller than the micropore diameter of the hydrophobic molecular sieve component of the adsorbent and a large molecular diameter non-polar solvent.

9. The method of claim 7 wherein the desorbing solvent comprises from 50 to 100 weight percent polar solvent, the balance being the large molecular diameter non-polar solvent.

10. The method of claim 8 wherein the desorbing solvent comprises from 50 to 100 weight percent polar solvent, the balance being the large molecular diameter non-polar solvent.

11. The method of claim 7 wherein the polar solvent component of the desorbent is dichloromethane or methylethylketone and the large molecular diameter non-polar solvent is isooctane.

12. The method of claim 8 wherein the polar solvent component of the desorbent is dichloromethane or methylethylketone and the large molecular diameter non-polar solvent is isooctane.

13. The method of claim 9 wherein the polar solvent component of the desorbent is dichloromethane or methylethylketone and the large molecular diameter non-polar solvent is isooctane.

14. The method of claim 10 wherein the polar solvent component of the desorbent is dichloromethane or methylethylketone and the large molecular diameter non-polar solvent is isooctane.

* * * * *